United States Patent [19]

St. Laurent, Jr.

[11] 4,263,838

[45] Apr. 28, 1981

[54] PNEUMATIC POSITIONER

[75] Inventor: Wilfred H. St. Laurent, Jr., Marblehead, Mass.

[73] Assignee: Bellofram Corporation, Burlington, Mass.

[21] Appl. No.: 923,594

[22] Filed: Jul. 11, 1978

[51] Int. Cl.[3] ..... F15B 13/16

[52] U.S. Cl. ..... 91/387; 91/388; 91/457; 137/85

[58] Field of Search ..... 91/387, 457, 454, 388

[56] References Cited

U.S. PATENT DOCUMENTS

| | | | |
|---|---|---|---|
| 2,432,705 | 12/1947 | Williams | 91/387 |
| 2,927,593 | 3/1960 | Hall et al. | 91/387 |
| 3,003,475 | 10/1961 | Rouvalis | 91/387 |
| 3,087,468 | 4/1963 | Roberts et al. | 91/387 |

*Primary Examiner*—Paul E. Maslousky
*Attorney, Agent, or Firm*—Erwin Salzer

[57] ABSTRACT

A force balance instrument providing precision control of pneumatic actuators in response to command pressure signals independent of external forces on the actuator shaft. The instrument includes a high gain signal detection circuit in combination with one or two pilot operated output valves. In the case of two output valves inverse "push-pull" control of a double acting pneumatic actuator is provided. Full supply pressure differential can be developed across the piston of the actuator, permitting to minimize the size of the actuator for any specified output force.

The positioner proper controls the position of valve actuator system through a stem connector arm and a feed-back spring. A force balance condition is initially established between the feedback spring and the force of a rolling diaphragm controlled piston assembly for the range of signal pressure $P_1$ to be used. Any change in this force balance condition because of a change in signal pressure $P_1$ produces a change in clearance between the above referred-to rolling diaphragm controlled piston assembly and a pilot nozzle. Air under pressure is fed from a chamber which may be referred-to as output chamber through a passageway having a restriction to a chamber which will be referred-to as a servo chamber. The servo chamber is vented through the orifice of the aforementioned nozzle and affixed to the aforementioned movable nozzle support which is, in effect, a rolling diaphragm controlled piston assembly. The above nozzle controls the exhaust rate of the serve chamber.

In double acting positioners a reversing valve is connected to the positioner proper.

9 Claims, 4 Drawing Figures

PNEUMATIC POSITIONER

BACKGROUND OF THE INVENTION

This invention relates to pneumatic positioners.

Devices of a similar or related description are disclosed in

U.S. Pat. No. 2,558,506 to D. H. Annin; June 26, 1951;

U.S. Pat. No. 2,830,785 to A. Buri; Apr. 15, 1958;

U.S. Pat. No. 2,880,705 to G. W. Scheider; Apr. 7, 1959;

U.S. Pat. No. 2,867,233 to S. L. Adelson; June 15, 1959;

U.S. Pat. No. 2,879,781 to A. E. Gimson; Mar. 31, 1959;

U.S. Pat. No. 2,911,991 to D. R. Pearl; Nov. 10, 1959; and

U.S. Pat. No. 2,942,581 to D. J. Gattney; June 28, 1960.

The closest prior art familiar to me is

U.S. Pat. No. 3,087,468 to B. R. Roberts et al; Apr. 30, 1963.

It is a general object of this invention to provide an improved pneumatic positioner.

Another object of this invention is to conserve air and to make the positioner less prone to clogging from dirty air. This is achieved by deriving the pilot pressure from the output side rather than the input or air supply side, and thus reducing the pilot pressure to typically 50% of the supply pressure. Thus positioners according to this invention require about 50% of the air flow or bleed of positioners wherein the pilot pressure is equal to the supply pressure. Alternatively, larger restrictions and nozzles can be used in positioners according to the present invention for an air flow equivalent to that of prior art positioners, wherein the pilot pressure is equal to the supply pressure, and this makes positioners according to the present invention less prone to clogging from dirty air.

Another object of this invention is to minimize the effects of overshoots in response to changes in signal pressure. This is achieved by incorporating a negative feedback action between the signal piston under the action of signal pressure, and the nozzle and its orifice wherein pilot pressure prevails. The nozzle is affixed to a nozzle support or piston assembly which moves in direct response to changes in servo pressure, and the nozzle motion is always in the same direction as that of the signal piston, thereby negating the throttling effect of the signal piston on the nozzle.

The embodiment of the invention shown in FIGS. 3 and 4 has the following advantages over prior art.

The amplifier relay AMP and the reversing relay RV, i.e. the two output valves, are coupled pneumatically rather than mechanically such as by lever, linkages, etc. This provides:

(a) greater stability of operation and settings in that small motions of mechanical parts relative to each other resulting from wear, thermal effects, and vibrations do not affect operation or calibration;

(b) less critical alignment of parts required, resulting in lower cost of assembly and greater reliability;

(c) lower sensitivity to changes in temperature and thermal gradients;

(d) greater immunity to vibration and shock.

Still another object of this invention is to achieve a faster response and a better dynamic stability than can be achieved by prior art controls that utilize the output pressure of one valve to control the output pressure of a second valve in an inverse manner, as by means of a reversing relay. The improvement in regard to response and dynamic stability is achieved by means of a novel pneumatic pilot circuit. The pressure in that pilot circuit is a function of the force balance relationship between a feedback spring and a signal-diaphragm-piston assembly. As the pilot pressure changes in the course of position control, the pilot pressure is channeled simultaneously to the power control stages of two inversely operating output valves.

Another object of this invention is to provide a pneumatic positioner having valve seats and valve elements that may be permanently, fixedly and rigidly fastened within each of the housings of the relays forming part of positioner according to this invention rather than requiring means to change the relative position of valve seats and valve elements, or move the same as by screw threads or levers. In positioners according to this invention adjustment of the balance pressure level is made by adjusting the compression of a spring, and unlike other prior art positioners does not involve relative positioning of valve seats or nozzles and valve elements.

Other objects of this invention will become apparent at this description of the invention progresses.

SUMMARY OF THE INVENTION

A positioner according to this invention comprises a first chamber formed by a housing having an input duct for admitting signals under air pressure to said first chamber. The latter is closed on opposite sides thereof by a first pair of rolling diaphragms having different effective areas and being mechanically interconnected to form a unit responsive to the pressure prevailing in said first chamber. A first spring is connected to the unit, i.e. to said first pair of rolling diaphragms and their mechanical tie means, the force of said first spring and the force of air under pressure prevailing in said first chamber being normally balanced. The aforementioned unit comprising a first pair of rolling diaphragms and a mechanical tie means interconnecting said pair of rolling diaphragms supports a plug adapted to cooperate with the orifice of a juxtaposed nozzle to control the outflow of air under pressure from said orifice. The housing forms a second chamber accommodating an end surface of said plug and said orifice of said nozzle, said second chamber being vented to atmosphere. Said second chamber is bounded on one end thereof by a partition of said housing, and said nozzle is slidably guided in said partition. A piston member is movably arranged in said housing, supporting said nozzle and defining a cavity vented to atmosphere through an aperture in said housing. The end surfaces of said piston member include a second pair of rolling diaphragms having radially outer ends affixed to said housing. The effective area of one of said second pair of rolling diaphragms adjacent said partition exceeds the effective area of the other of said second pair of rolling diaphragms. The space between said partition and said one of said second pair of rolling diaphragms defines a third chamber inside said housing and said nozzle has its intake end in said third chamber. A second spring is interposed between said partition and said piston member tending to increase the spacing between said partition and said piston member in response to increased venting of said second chamber by said nozzle. A fourth chamber inside said housing is situated adjacent said other of said second pair of rolling diaphragms. A connection for the flow of air under pressure between said third chamber or servo chamber and said fourth chamber is provided, said connection having a point of restricted cross-sectional area so that the pressure in said third chamber may differ from the pressure in said fourth chamber. The latter has also an output passageway for connecting the same to an external device. Finally the positioner according to the present invention includes a pair of valves each having two operating positions depending on the difference in pressure prevailing in said third chamber and said fourth chamber. One of said pair of valves controls the passage from said fourth chamber through said cavity in said piston member to atmosphere, and the other of said pair of valves controls the passage for the admission of air under pressure from a source of air under pressure to said fourth chamber, said pair of valves being coupled in such a way that when one of said pair of valves opens, the other of said pair of valves closes, and when one of said pair of valves closes, the other of said pair of valves opens.

DESCRIPTION OF PREFERRED EMBODIMENTS

Figure 1:
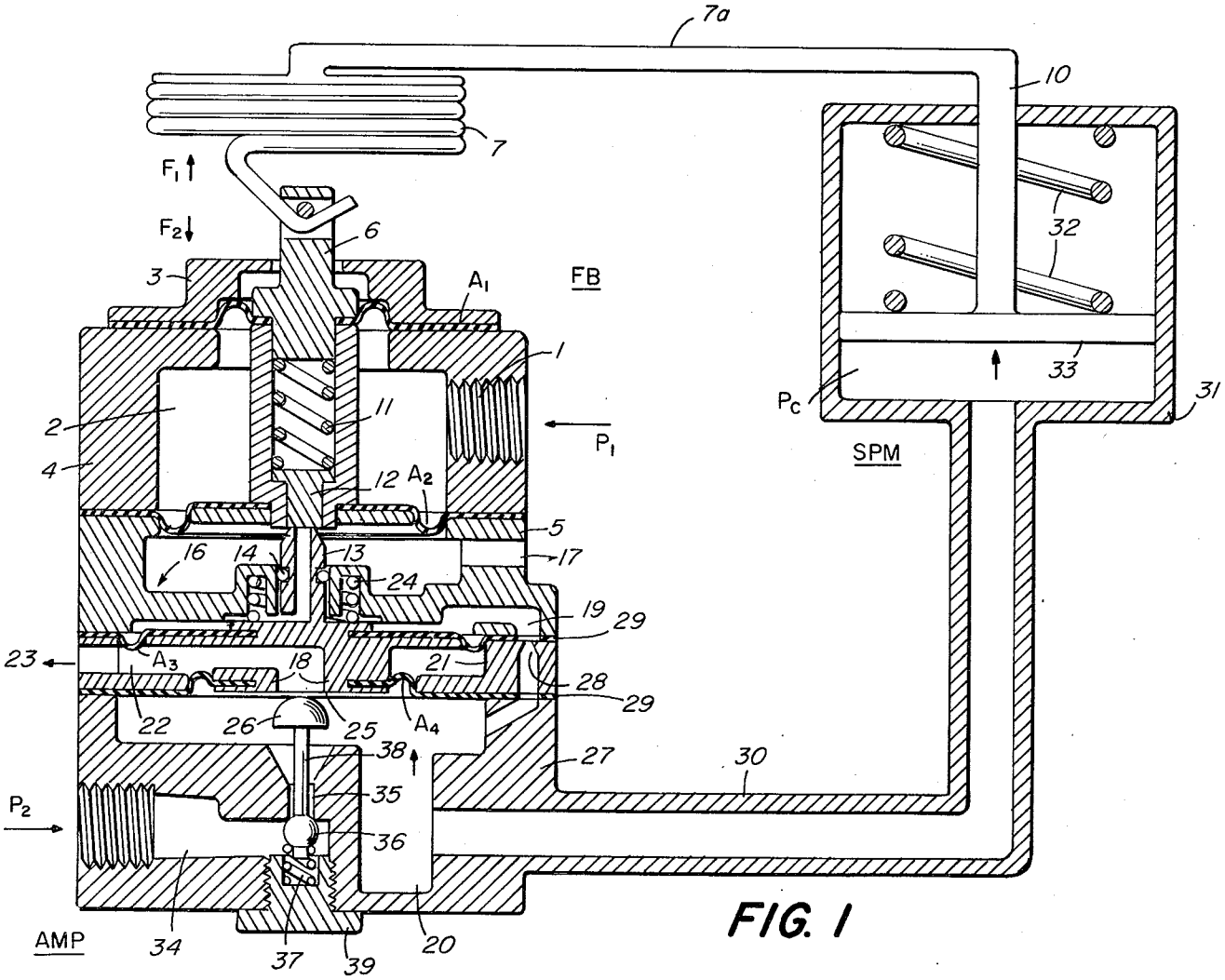
FIG. 1 shows partly in vertical section and partly in elevation a positioning device according to the present invention in one limit position thereof.
Figure 2:
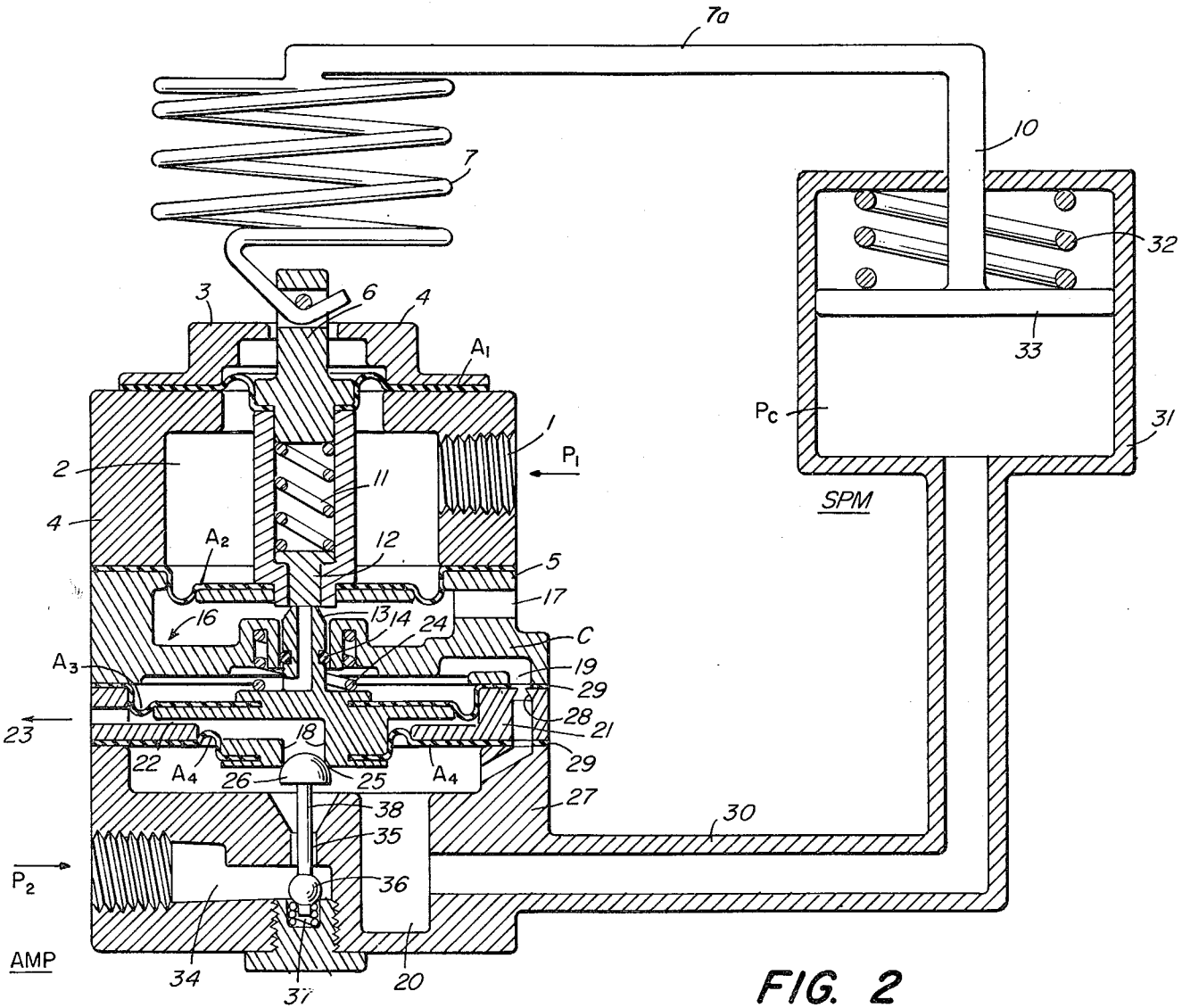
FIG. 2 shows the same device as FIG. 1 in the same way as FIG. 1 in the other limit position thereof.

Referring now to FIGS. 1 and 2, letters FB have been applied to generally indicate a force balance device, letters AMP have been applied to generally indicate a fluid amplifier and letters SPM have been applied to indicate a fluid motor, or actuator.

The housing of force balance device FB is provided with a port 1 for the admission of signal pressure $P_1$ to chamber 2. The latter is axially bounded by rolling diaphragms $A_1$ and $A_2$. Rolling diaphragms $A_1$ and $A_2$ are supported at their radially outer ends by parts 3,4 and 5 forming the housing of force balance device FB. The radially inner ends of rolling diaphragms $A_1$ and $A_2$ are affixed to a plunger or piston assembly 6 which is spring biased in upward direction by a feedback spring 7. One end of spring 7 is attached by means of the bar *7a* to piston rod 10 of spring motor or actuator SPM. It will be apparent from all the figures in this text that bar *7a* performs only translatory rather than rotary motions in operating piston 33 of motor SPM to which it is attached. Plunger 6 is hollow and houses a spring 11 whose lower end rests against a stopper 12 cooperating with the orifice of a nozzle 13 to open or close said nozzle. The spacing between the plane defined by the orifice of nozzle 13 and the plane defined by stopper 12 will hereinafter be referred to as the clearance between parts 12 and 13. The area of rolling diaphragm $A_2$ exceeds that of rolling diaphragm $A_1$. Thus the signal pressure $P_1$ biases plunger 6 in downward direction. In the state of balance the force exerted by pressure $P_1$ is balanced by the force of spring 7. The purpose of spring 11 is to cushion the impact of stopper 12 and nozzle 13 when, upon disengagement thereof, they meet again to close the orifice of nozzle 13.

Nozzle 13 is adapted to slide up and down in axial direction in a partition C above parts 18 and $A_3$. Partition C and nozzle 13 are provided with a circular groove receiving an O-ring 14. Other equivalent sealing means may be used to seal nozzle 13 from its surrounding wall structure. That wall structure defines a chamber 16 which is open to atmosphere at 17 and hence may be referred-to as venting chamber. Nozzle 13 forms part of a movable nozzle support or piston assembly 18 jointly movable with nozzle 13 in upward and downward direction. Nozzle support 18 is provided with a rolling diaphragm $A_3$. The radially inner end of rolling diaphragm $A_3$ is affixed to nozzle support or piston assembly 18, while the radially outer end of rolling diaphragm $A_3$ is fixedly secured to the housing structure 21. Nozzle support or piston assembly 18 defines a movable venting chamber 22 which is open to atmosphere at 23. This chamber may be referred-to as second venting chamber. Spring 24 biases nozzle support or piston assembly 18 in downward direction. The exhaust passageway 22, 23 is controlled by a valve including valve seat 25 on assembly 13,18 and a cooperating tap 26, or the like valve element. Rolling diaphragm $A_4$ has a radially inner end affixed to nozzle support or piston assembly 18 and a radially outer end affixed to the housing structure, i.e. resting on part 27. The effective area of rolling diaphragm $A_3$ exceeds the effective area of rolling diaphragm $A_4$. Chambers 19 and 20 communicate by a passageway 28 which has a point of restricted cross-sectional area. Consequently the pressure in chamber 19 may differ from that in chamber 20. It will be noted that the right side of diaphragms $A_3$ and $A_4$ is perforated at points 29 to establish a passageway from chamber 20 to chamber 19. It should also be noted that the restricted passageway 28 is situated entirely inside of the housing FB and AMP, which is achieved by perforations in diaphragms $A_3$ and $A_4$. Chamber 20 communicates by way of pipe 30 with the side of the cylinder 31 of spring motor or actuator SPM not occupied by spring 32. Spring 32 biases the cylinder 33 of spring motor SPM in downward direction. Due to pipe 30 the pressure in output chamber 20 is always the same as that under piston 33, i.e. the output pressure of valve AMP is always equal to cylinder pressure Pc.

Housing 27 defines another passageway 34 for the admission of air under the pressure $P_2$. In the position of parts shown in FIG. 1 no air under pressure may be admitted from passageway 34 through passageway 35 into chamber 20 because passageway 35 is sealed off by valve element 36. In the position of parts shown in FIG. 2 venting passageway 22,23 is open since valve 25,26 is open, thus allowing venting of chamber 20. On the other hand, valve element 36 seals passageway 35 thus precluding admission of air under pressure $P_2$ to output chamber 20.

The pressure prevailing in chamber 20 acts upwardly upon diaphragm $A_4$ and tends to raise nozzle support or piston assembly 18 and nozzle 13 against the action of biasing spring 24 and against the servo pressure in chamber 19. The ball valve element 36 controlling passageway 35 is spring biased by spring 37. Valve elements 26 and 36 have a joint valve stem 38 extending through passageway 35, the cross-sectional area or diameter of which exceeds the cross-sectional area or diameter of rod or valve stem 38. Biasing spring 37 is positioned by hollow screw 39.

FIG. 1 shows valve 25,26 in the open position thereof and valve element 36 in its closed position.

FIG. 2 shows nozzle 13 and nozzle support or piston assembly 18 in its lower position due to the pressure in chamber 19 and the expansion of helical biasing spring 24. The lowering of parts 13 and 18 resulted in closing valve 25,26 and blocking of venting passage 22, 23. It resulted further in opening of valve 36 and admission of supply air under pressure $P_2$ through passageways 34 and 35 into chamber 20.

Part 6 is pulled upwardly by a force $F_1$ exerted by spring 7 whose right end is affixed to piston rod 10 by tie bar *7a*. The travel of piston 33 is proportional to $F_1$, or piston travel $P_T=K_1 \cdot F_1$. Hence $F_1=(P_T/K_1)$. The pressure exerted by the signal pressure $P_1$ in chamber 2 is $F_2$. The force $F_2$ is opposite to that of $F_1$. If $A_1$ is the area of diaphragm $A_1$, and $A_2$ the area of diaphragm $A_2$, then $F_2=P_1(A_2-A_1)=P_1 \cdot K_2$. The equilibrium condition is expressed by the equation $F_1=F_2$, or $P_1 \cdot K_2=(P_T/K_1)$.

Plotting the signal pressure $P_1$ against $P_T$ yields a straight line, i.e. the travel of piston 33 is proportional to $P_1$, or the signal pressure prevailing in the signal pressure chamber 2.

Figure 3:
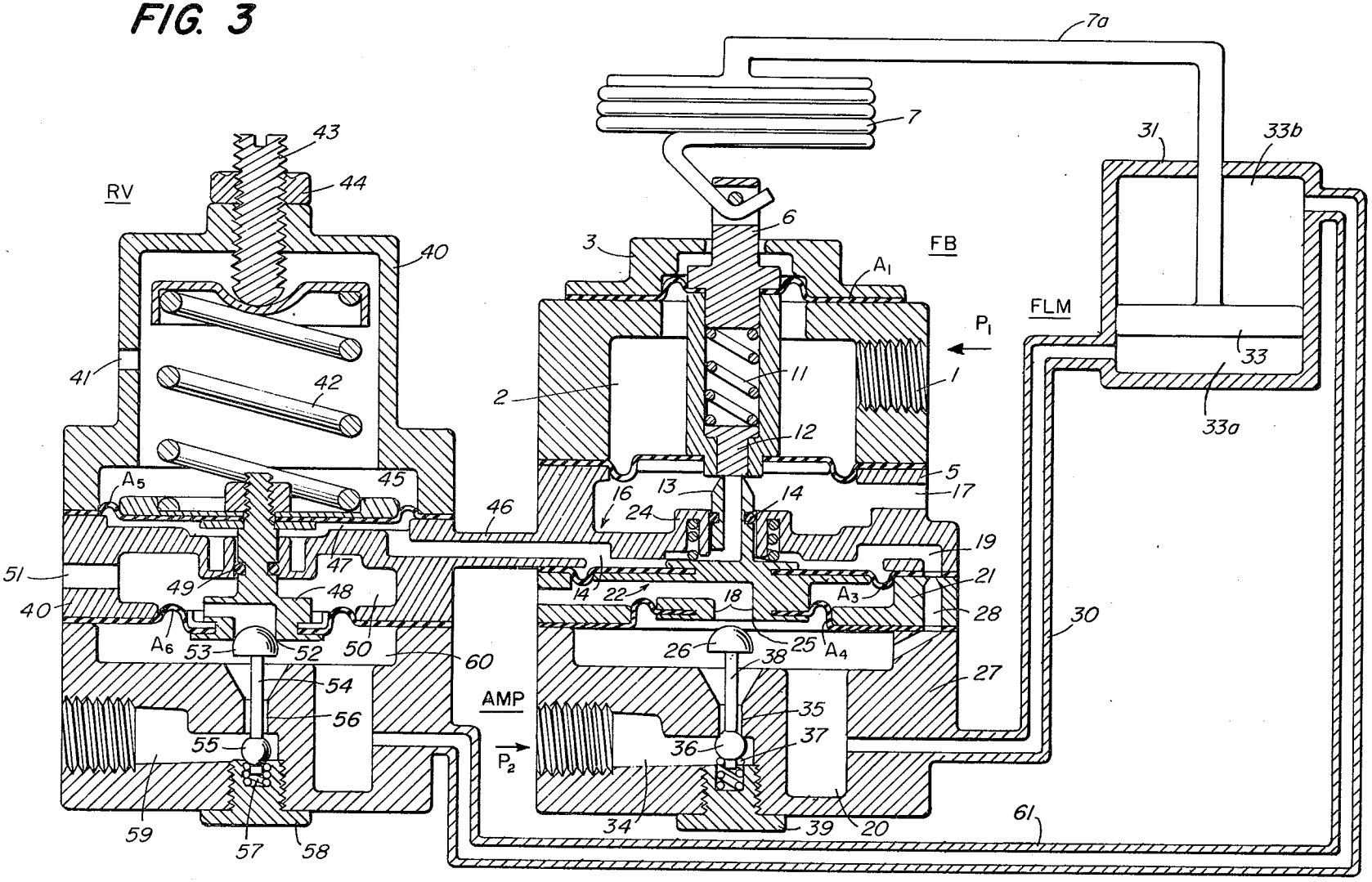
FIG. 3 shows partly in vertical section and partly in elevation push-pull positioning device according to the present invention in one limit position thereof.
Figure 4:
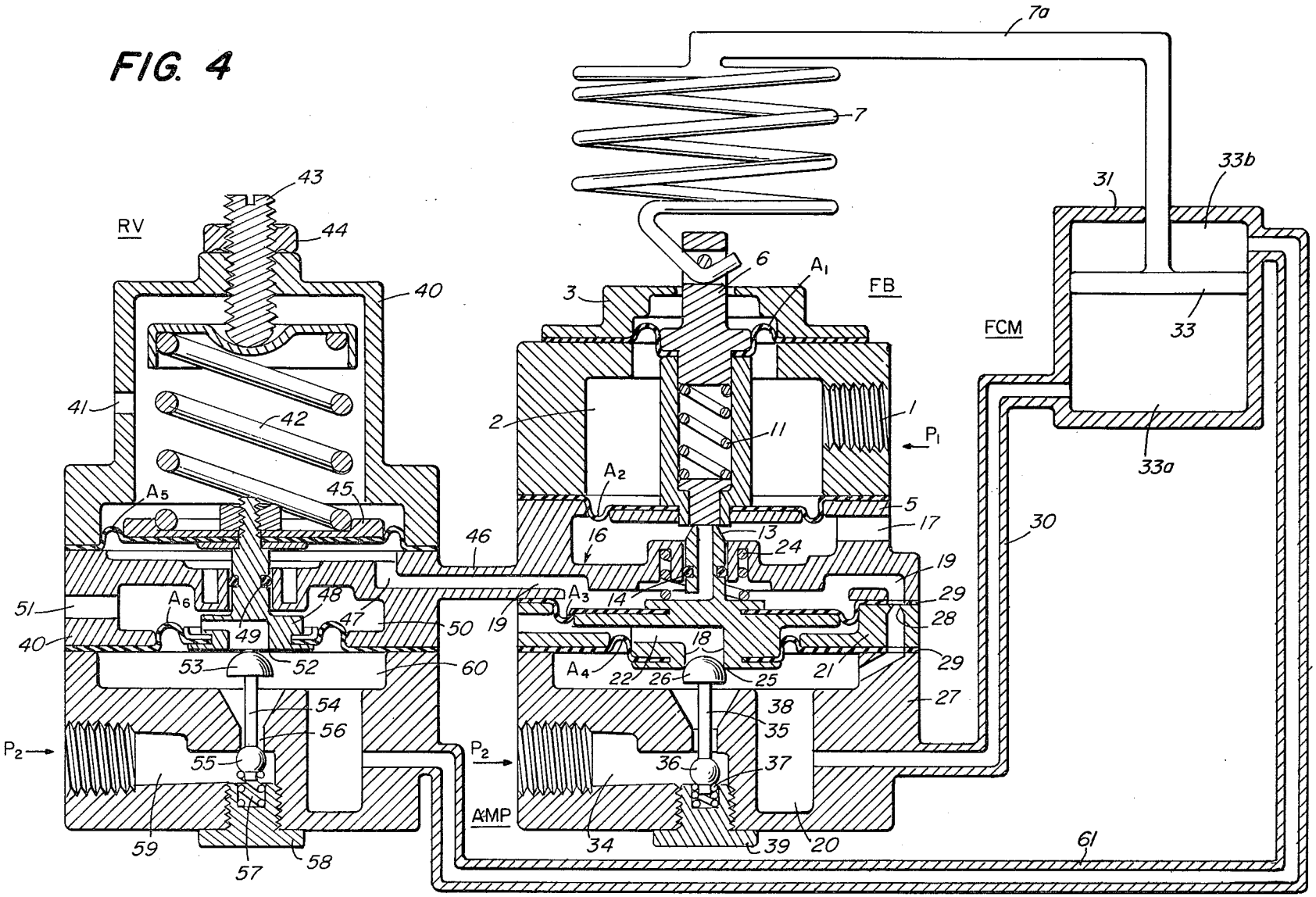
FIG. 4 shows the same device as FIG. 3 in the same way as FIG. 3 in the other limit position thereof.

In FIG. 2 the same reference characters have been applied to designate the same or like parts as in FIG. 1, and this applies also to FIGS. 3 and 4. While the actuator motor SPM of FIGS. 1 and 2 is a spring motor, i.e. a motor whose piston is acted upon on one side thereby by a spring, and on the other side by the pressure of a air under pressure, the motor FLM of FIGS. 3 and 4 is a motor whose piston 33 is moved upwardly by excess pressure in portion 33*a* of cylinder 31, and moved downwardly by excess pressure in portion 33*b* of cylinder 31. The structure of FIGS. 3 and 4 requires a push-pull action for its operation, as will be explained below in greater detail.

The right portion of the structure shown in FIGS. 3 and 4, i.e. force balance device FB and amplifier AMP are the same as in FIG. 1, and the same reference characters have been applied in FIGS. 1-4 to indicate like parts.

Referring now to FIG. 3, showing the so-called reversal relay RV, housing 40 is vented at 41 and contains main spring 42. The downward pressure of spring 42 may be adjusted by means of set-screw 43 which may be tightened by a nut 44. The downward pressure of spring 42 is transmitted to piston or piston assembly 45 and rolling diaphragm $A_5$, respectively. A conduit or pipe 46 connects chamber 19 with a chamber 47 below rolling diaphragm $A_5$. Piston 45 is affixed to a movable valve part 48 to which the radially inner side of rolling diaphragm $A_6$ is attached. The radially outer side of rolling diaphragm $A_6$ is attached to housing 40. The effective area of rolling diaphragm $A_5$ exceeds the effective area of rolling diaphragm $A_6$. An O-ring 49, or equivalent seal, is interposed between a supporting rod for valve part 48 and a partition C of housing 40. Seal 49 separates chamber 47 from chamber 50 vented at 51. Movable valve part 48 forms a movable valve seat at 52 cooperating with a pintle or valve element 53. Pintle or valve element 53 is connected by a valve stem 54 with pintle or valve element 55 controlling passageway 56. Pintle 55 is biased by spring 57 in upward direction. Spring 57 is arranged in a cavity of screw 58. Housing 40 defines a passageway 59 for the admission of air from a supply of air under pressure $P_2$, which supplies also passageway 34. Housing 40 further defines an output chamber 60 connected by pipe 61 to upper cylinder chamber 33*b*.

Referring now to FIGS. 1 and 2 and assuming that the signal pressure $P_1$, i.e. the pressure in chamber 2, is increased over the equilibrium force balance condition as expressed by the above equations. This produces a decrease of the clearance between the orifice of nozzle 13 and plug member 12 and a concomitant increase of the pressure in chamber 19. The relative sizes of nozzle 13 and restriction 28 are selected typically in a 2:1 ratio, approximately, so that servo pressure is readily varied in response to nozzle clearance. As the nozzle clearance decreases, the nozzle pressure increases, increasing the servo pressure in chamber 19. The pressure in chamber 19 acts on diaphragm $A_3$ resulting in downward movement of nozzle support 18, closing of valve 25,26, withdrawal of valve element or pintle 36 from its seat until the pressure in chamber 20 increases to such an extent as to re-establish a force balance condition on nozzle support or piston assembly 18. The force balance condition is re-established when the servo pressure acting on diaphragm $A_3$ plus the pressure of spring 24 balances the pressure acting on diaphragm $A_4$. Typically a ratio of 3:1 of servo pressure to output pressure areas is desirable. For this ratio the pressure in chamber 19 is $\frac{1}{3}$ of output pressure in chamber 20 for equilibrium conditions.

Assuming now that the signal or control pressure $P_1$ is decreased rather than increased. This causes an increase of the gap between parts 12 and 13 due to the temporary force unbalance of part 6 which is moved upwardly by the minus pressure upon diaphragm $A_2$. The increase of the nozzle gap results in a decrease of the servo pressure in chamber 19. As a result, valve seat 25 is separated from pintle or valve element 26, and chamber 20 is vented through passageways 22 and 23 until the new servo pressure in chamber 19 is balanced by the new output pressure in chamber 20.

In the embodiment of the invention shown in FIGS. 1-4—which is the preferred embodiment—feedback spring 7 is a tension spring, and diaphragm $A_1$ has a smaller effective area than diaphragm $A_2$. Instead of a tension feedback spring 7, a compression feedback spring may be used. In this case the area of diaphragm $A_1$ must be made larger than the area of diaphragm $A_2$.

As previously described the servo pressure in chamber 19 is derived from that in chamber 20 by means of restricted passageway 28. The pressure in chamber 20 is controlled by valve or pintle 36 in response to the force unbalance acting upon nozzle support or piston assembly 18 and nozzle 13. In order to prevent the pressure in chamber 19 from ever dropping to zero, which would prevent start-up servo pressure control in response to changes in nozzle clearance, spring 24 is provided. This spring 24 biases the force balance on nozzle piston assembly 13,18. The force of spring 24 is equivalent to approximately 2 psig in chamber 20, so that even for full exhaust of chamber 19, i.e. when the servo pressure is equal to zero psig, the pressure in chamber 20 never drops below about 2 psig.

In the operation of the structure shown in FIGS. 1 and 2 it may occur that piston 33 does not quite reach, or undershoots, the position it actually should be in.

Assuming that as a result of such a situation, the upward force acting upon piston assembly 6,12 overcomes the downward force of the signal pressure $P_1(A_2-A_1)$.

This causes an upward movement of piston assembly 6,12 and a concomitant increase of the nozzle gap between parts 12 and 13. Hence the nozzle pressure tends to go down to zero, but the cylinder pressure Pc acting on diaphragm $A_4$ causes nozzle piston assembly 13,18 to move upwardly. This, in turn, causes opening of valve 25,26 and venting of cylinder pressure Pc through passageway 22,23 to atmosphere until equilibrium conditions are reached. This situation is shown in FIG. 1. Piston 33 is still above the position it should be in. Feedback spring 7 is stressed above the force balance condition and tie bar 7*a* transmits a force above the force balance value.

The reverse of the above described steps occur when the piston 33 overshoots the position it should be in. This has been shown in FIG. 2. Piston 33 has overshot the position it should be in, i.e. it should be in a higher position. Spring 7 is stressed below the force balance equilibrium value, the downward pressure force acting on piston assembly 6,12 being greater decreases the plug-and nozzle clearance 12,13 and increases the servo pressure in chamber 19. The increased servo pressure in chamber 19 acts on diaphragm $A_3$. Nozzle and piston assembly 13,18 is moved downardly closing valve 25,26 and opening valve element 36. As valve element 36 opens, supply air having the pressure $P_2$ is admitted to chamber 20 and from there to cylinder 31. As pressure $P_c$ builds up, piston 33 moves upwardly to the proper equilibrium position.

During normal operation the pressure Pc in chamber 20 is typically 50% of the pressure $P_2$ of the main air supply. Therefore, air flow through restricted passage 28 and pilot nozzle 13 is approximately 50% of the air flow that would occur if the higher pressure supply air had been used as a source of servo air.

Since the supply pressure $P_2$ does not directly affect the servo pressure in chamber 19, the effect of variations in supply pressure on the operational performance of the positioner are virtually zero.

Referring now again to FIG. 1, it is apparent that as piston assembly 6,12 $A_1$,$A_2$ moves toward nozzle 13, the build-up of servo pressure in chamber 19 acts on diaphragm $A_3$ and causes nozzle piston assembly 13,18 to move away from piston assembly 6,12. This—as mentioned above—is a negative feedback which allows high gain without instability.

Referring now to FIGS. 3 and 4, passageway or tubing 46 admits the servo pressure from chamber 19 into chamber 47 of the reversing relay RV, where it acts upon rolling diaphragm A5 against the action of spring 42.

Assuming that the pressure in compartment 33*a* of cylinder 31 has decreased, resulting in a decrease of pressure in output chamber 20 and decrease of servo pressure in chamber 19 and chamber 47. This pressure acts on rolling diaphragm $A_5$, and is overcome by the force of spring 42, causing assembly 48 to move in downward direction. This causes closing of valve 52,53 and hence blocking of exhaust 51. The downward movement of valve element 53 is transmitted by stem 54 to pintle or valve element 55 which is removed from its seat, thus clearing passageway 56. Air from a supply having the pressure $P_2$ is allowed to flow from chamber 59 through passageway 56 into output chamber 60, and from there through pipe line or conduit 61 to cylinder compartment 33*b*.

The above situation has been shown in FIG. 3.

The flow of air under pressure through pipe 61 to space 33*b* in cylinder 31 tends to lower piston 33. This, in turn, stresses spring 7 to exert less pull on the differential piston unit including rolling diaphragms $A_1$ and $A_2$. Hence the clearance between plug 12 and nozzle 13 is reduced and the pressure in chambers 19 and 47 increased. This causes lifting of piston unit 48, separation of valve element 53 from its seat 52, venting of chamber 60 through passage 51 to atmosphere and reducing of passage 56 by valve element 55. Hence the flow of air under pressure through pipe 61 is reduced until equilibrium conditions are re-established.

Assuming that the pressure in compartment 33*a* of cylinder 31 is too high, resulting in an increase of the servo pressure in chambers 19 and 47. This pressure acts on rolling diaphragm $A_5$, further compresses spring 42 and causes part 48 to rise. This causes separation of valve seat 52 from pintle or valve element 53 and venting of chamber 60 through orifice 51. Spring 57 acts to move pintle or valve element 55 to its seat in passageway 56, thus blocking passageway 56 to any flow of air under pressure from input chamber 59 to chamber 60 and conduit or pipe line 61. This process takes place until equilibrium conditions are re-established.

The above situation has been shown in FIG. 4.

It will be apparent from the above that nozzle 13 must be closed if the pressure in cylinder compartment 33*a* is too low, and that nozzle 13 must be vented to atmosphere if the pressure in cylinder compartment 33*a* is too high, as explained in more detail in connection with FIGS. 1 and 2.

In FIGS. 1 to 4, inclusive, O-rings 14 have been provided as preferred means for sealing chamber 16 vented at 17 from servo chamber 19. If desired, these O-rings may be replaced by rolling diaphragms. In a like fashion the O-rings 49 provided in the reversing relay RV of FIGS. 3 and 4 to separate chambers 47 and 50 may be replaced by rolling diaphragms as sealing means.

As is apparent from FIGS. 3 and 4, as servo pressure in chamber 47 increases, output pressure in chamber 60 decreases. Screw 43 is used to adjust the compression of spring 42, which determines the nominal values of the pressures acting on rolling diaphragms $A_5$ and $A_6$ for force balance.

Since chambers 19 and 47 are interconnected by pipe line or conduit 46, the operation of pintles or valve elements 36 and 55 occurs simultaneously in response to changes of servo pressure. An increase of pressure in output chamber 20, and a decrease of pressure in output chamber 60 occur, therefore, simultaneously.

As stated above, a decrease of signal pressure $P_1$ results in a temporary force unbalance of assembly 6,12 which increases the clearance between nozzle 13 and plug 12. This causes servo pressure in chambers 19 and 47 to decrease. The resultant effect is a decrease in output pressure, i.e. a decrease of the pressure in chamber 20. The decrease of servo pressure in chamber 47 also produces an increase in output pressure, i.e. the pressure in chamber 60 which is controlled by the force balance of piston assembly 48. In this case piston assembly 48 moves pintle or valve element 55 out of engagement with its seat and pintle 53 into engagement with its seat 52 so as to allow admission of supply air into output chamber 60. This transient condition lasts until the force balance condition on assembly 48 is re-established. When this occurs, there is neither flow into, or out of, chambers 20 and 60.

It can be shown that the effective clearance of nozzle 13 and plug 12 is directly related to the diameter of restricting orifice in passageway 28, and the length of feedback spring 7 is not affected by nozzle clearance. The effect of this is to increase the positioning accuracy of the actuator with respect to varying external loads.

Summarizing the essential features of the structure of FIGS. 3 and 4, the following features are believed novel and inventive.

The coupling of valves 25,26 and 52,53 and of valves 36 and 55 is accomplished with pilot stage or servo air pressure by means of passageway or conduit 46 connecting units AMP and RV.

The adjustment of balance pressure is achieved by means of screw 43 and spring 42 in relay RV.

Pilot air pressure in chamber 19 is derived from the output side or chamber 20 of relay AMP through restriction 28. As the pilot pressure increases, the port controlled by valve element 36 increases and the passageway controlled by valve 25,26 decreases. The same applies also to reversing relay RV in regard to the port controlled by valve element 55 and the passageway controlled by valve 52,53.

The fixed bias spring 24 serves the purpose of preventing the pressure in the pilot stage from going to zero which would cause lock-up.

Pilot nozzle 13 is provided with negative feedback means comprising nozzle support 18 and rolling diaphragms $A_3$,$A_4$ which form a piston assembly.

Overload protection of pilot nozzle 13 is provided by plunger 12 loaded by spring 11 located in the signal assembly 6. The load of spring 11 is such to keep plunger 12 inoperative except in overload conditions.

It will be apparent from the above that the structure of FIGS. 1 and 2 includes four chambers, namely chamber 2 housing the assembly $A_1$,$A_2$, 12 and 6; chamber 16 vented at 17 and accommodating the gap or clearance formed between plunger 12 and nozzle 13; chamber 19 or servo chamber bounded by partition C and rolling diaphragm $A_3$, and output chamber 20 communicating with chamber 19 by restricted passageway 28 and whose pressure is controlled by valves 25,26 and 35,36.

Summarizing the above referred-to operational steps of the pneumatic positioner according to the present invention, the following steps occur if the signal pressure $P_1$ increases above equilibrium balance conditions.

(1) The pressure in chamber 2 is increased and unit $A_1$,$A_2$,6 and 12 moves against the action of spring 7 in downward direction;

(2) The increased pressure in chamber 2 decreases the width of the gap, or the clearance, between plug 12 and nozzle 13, resulting in decreased venting of chamber 16 through venting opening 17;

(3) This results in an increase of servo pressure in chamber 19 bounded by partition C and rolling diaphragm $A_3$;

(4) The increase in servo pressure in chamber 19 results in a downward movement of nozzle-and-piston unit 13,18;

(5) The downward movement of nozzle-and-piston unit 13,18 tending to close valve 25,26 and passageway 22,23 and tending to open valve 35,36 so that air under pressure $P_2$ is admitted to chamber 20 and from there via duct 30 to actuator PSM. This process takes place until force balance conditions on nozzle-and-piston unit 13,18 are re-established.

The reverse of the above described steps occurs when the pressure $P_1$ increases.

The embodiment of FIGS. 3 and 4 differs from that of the embodiment of FIGS. 1 and 2 only by the fact that the reversing relay RV and pipe line 61 take the place of spring 32.

I claim as my invention:

1. In a pneumatic positioner the combination of (a) a housing;

(b) a first chamber (2) formed by said housing having an input duct (1) for connecting said first chamber (2) to a source of signals of air under pressure;

(c) said first chamber (2) being closed on opposite sides thereof by a first pair of rolling diaphragms ($A_1$,$A_2$) having different effective areas and being mechanically interconnected to form a unit ($A_1$,$A_2$,6,12) responsive to the pressure prevailing in said first chamber (2);

(d) a first spring (7) having one end connected to an external device and the other end connected to said unit, the force of said first spring and the force of air under pressure prevailing in said first chamber (2) being normally balanced;

(e) a plug (12) supported by said unit ($A_1$,$A_2$,6,12) and adapted to cooperate with an orifice of a juxtaposed nozzle (13) to control the outflow of air under pressure from said orifice;

(f) a second chamber (16) accommodating an end surface of said plug (12) and said orifice of said nozzle (13) and being vented to atmosphere (17);

(g) said second chamber (16) being bounded on one side thereof by a fixed partition (C) of said housing and said partition having an aperture in which said nozzle is slidably guided;

(g) a piston member (18) movably arranged in said housing, supporting said nozzle (13) and defining a cavity (22) vented to atmosphere through an aperture (23) in said housing;

(i) the end surfaces of said piston member including a second pair of rolling diaphragms (29,29) having radially outer ends affixed to said housing, one of said second pair of rolling diaphragms (29,29) adjacent said partition (C) having a larger effective area than the other of said second pair of rolling diaphragms (29,29);

(j) the space between said partition (C) and said one of said second pair of rolling diaphragms (29,29) defining a third chamber (19) inside said housing and said nozzle (13) having its intake end in said third chamber (19);

(k) a second spring (24) interposed between said partition (C) and said piston member (18) tending to increase the spacing between said partition (C) and said piston member;

(l) a fourth chamber (20) inside said housing situated on the side adjacent said other of said second pair of rolling diaphragms (29,29);

(m) a connection for the flow of air under pressure between said third chamber (19) and said fourth chamber (20) having a point of restricted cross-sectional area;

(n) a passageway (30) for connecting said fourth chamber (20) with said external device; and (o) a pair of valves (25,26;35,36) each having two operating positions depending upon the difference in pressure in said third chamber (19) and said fourth chamber (20), one of said pair of valves (25,26) controlling a passage from said fourth chamber (20) through said cavity (22) in said piston member (18) to atmosphere (23) and the other of a pair of valves (35,36) controlling a passage for the admission of air under pressure from a source of air under pressure to said fourth chamber (20), said pair of valves (25,26;35,36) being coupled in such a way that when one of said pair of valves (25,26) opens the other of said pair of valves (35,36) closes, and when one of said pair of valves (25,26) closes, the other of said pair of valves (35,36) opens.

2. A pneumatic positioner as specified in claim 1 wherein said restricted connection for the flow of air under pressure between said third chamber (19) and said fourth chamber (20) is situated inside said housing and projects through said second pair of rolling diaphragms (29,29).

3. A pneumatic positioner as specified in claim 1 having sealing means interposed between said nozzle (13) and said partition (C).

4. A pneumatic positioner as specified in claim 1 wherein said pair of valves (25,26; 35,36) having two operating positions include a rod (38) spring biased in a direction longitudinally thereof, said rod (38) being arranged in a duct having a larger cross-sectional area than said rod, said duct interconnecting said passage for the admission of air under pressure from said source of air under pressure to said fourth chamber (20), a first valve element (26) on one end of said rod and a second valve element (36) on the opposite end of said rod, when said first valve element (26) allows venting of said fourth chamber (20) said second valve element (36) closing said duct, and when said first valve element (26) precludes venting of said fourth chamber (20), said second valve element (36) opens said duct.

5. A pneumatic positioner as specified in claim 1 wherein (a) said external device includes a cylinder (31) arranged in spaced relation from said housing and a piston (33) movably arranged in said cylinder (31);

(b) tie means (7*a*) interconnecting the end of said first spring (7) remote from said unit ($A_1$,$A_2$,6,12) and said piston (33), said tie means (7*a*) being adapted to perform translatory motions but no rotary motions;

(c) said passageway (30) connecting said fourth chamber (20) to one side of said cylinder (31) to exert a force against said piston proportional to the pressure of air in said fourth chamber (20); and (d) means capable of exerting a variable force to the opposite side of said piston (33) in addition to the force that may be exerted to said piston (33) by said first spring (7).

6. A pneumatic positioner as specified in claim 1 wherein (a) said external device includes a cylinder (31) arranged in spaced relation from said housing and a piston (33) movably arranged in said cylinder (31);

(b) said first spring (7) being a helical tension spring having one end thereof attached to said unit ($A_1$,$A_2$,6,12) and the other end thereof connected by a tie bar (7*a*) to said piston (33) inside said cylinder (31);

(c) the effective area of one ($A_1$) of said first pair of rolling diaphragms ($A_1$,$A_2$) closing said first chamber (2) adjacent said first spring (7) being less than the effective area of the other ($A_2$) of said first pair of rolling diaphragms ($A_1$,$A_2$);

(d) a passageway (30) connecting said fourth chamber (20) of said housing means to one side of said cylinder (31) to exert a force against said piston (33) proportional to the pressure of air in said fourth chamber (20); and (e) means capable of exerting a variable force on the opposite side of said piston (33) in addition to the force that may be exerted by said first spring (7).

7. A pneumatic positioner as specified in claim 6 wherein said cylinder (31) includes a spring (32) exerting a force against said piston (33) opposite to the force exerted on said piston (33) by the air pressure prevailing in said fourth chamber (20).

8. A pneumatic positioner as specified in claim 6 including (a) a reversing relay (R,V) having a reversing relay input duct (59) and a reversing relay output duct (61), said reversing relay (R,V) being capable of reversing the pressure of air under pressure admitted to said reversing relay input duct (59) at said reversing relay output duct (61);

(b) said reversing relay (R,V) further having an additional reversing relay duct (46) for the admission of air controlling the operation of said reversing relay (R,V) to a reversing relay control chamber (47);

(c) said third chamber (19) of said housing being connected by said additional reversing relay duct (46) to said reversing relay control chamber (47); and (d) tubular means connecting said reversing relay output duct (61) to the space (33*b*) of said cylinder (31) on the opposite side of said piston (33) to which the air pressure prevailing in said fourth chamber (20) is applied.

9. A pneumatic positioner as specified in claim 8 including (a) a reversing relay housing (R,V);

(b) a fixed partition in said reversing relay housing having a central bore;

(c) said fixed partition and a first reversing relay rolling diaphragm ($A_5$) defining therebetween said first reversing relay control chamber (47);

(d) adjustable spring means (42) acting on said first reversing relay rolling diaphragm ($A_5$) tending to counteract the pressure prevailing in said first reversing relay control chamber (47);

(e) a rod-shaped member affixed to said first reversing relay rolling diaphragm ($A_5$) slidably projecting through said central bore in said fixed partition and supporting a valve seat element (48) on the side thereof opposite said first reversing relay rolling diaphragm ($A_5$);

(f) said fixed partition and a second reversing relay rolling diaphragm ($A_6$) spaced from said fixed partition defining a vented (51) second reversing relay chamber (50);

(g) a third reversing relay chamber (60) adjacent said second reversing relay chamber (50) and separated from said second reversing relay chamber (50) by said second reversing relay rolling diaphragm ($A_6$);

(h) said second reversing relay rolling diaphragm ($A_6$) being supported on opposite ends thereof by said reversing relay housing and said valve seat element (48), and said valve seat element (48) defining a passageway interconnecting said second reversing relay chamber (50) and said third reversing relay chamber (60); and (i) reversing relay valve means (52;53;55;56) controlling the exhaust of air under pressure from said third reversing relay chamber (60) and the admission of air under pressure from a source of air under pressure into said third reversing relay chamber (60), said reversing relay valve means including a reversing relay shaft (54), means defining a reversing relay passageway (56) for said reversing relay shaft (54) leaving a clearance between said reversing relay shaft and said reversing relay passageway (56), a pair of reversing relay valve elements (53,55) each on opposite ends of said reversing relay shaft (54), and spring means (57) biasing said reversing relay shaft (54) in a direction longitudinally thereof, one of said pair of reversing relay valve elements (53) blocking the exhaust of air under pressure from said third reversing relay chamber (60) through said passageway in said valve seat element (48) into said second reversing relay chamber (50), and the other of said pair of reversing relay valve elements (55) simultaneously admitting air under pressure from said source of air under pressure to said third reversing relay chamber (60) when the pressure in said additional reversing relay duct (46) is relatively low, and said one of said pair of reversing relay valve elements (53) allowing the exhaust of air from said third reversing relay chamber (60) through said passageway in said valve seat element (48) into said second reversing relay chamber (50) and said other of said pair of reversing relay valve elements (55) simultaneously blocking the admission of air under pressure to said third reversing relay chamber (60) when the pressure in said additional reversing relay duct (46) is relatively high.

* * * * *